United States Patent [19]

Roe

[11] 4,155,130

[45] May 22, 1979

[54] MEANS FOR RESTRAINING CROSS HELICAL SPIN-OUT

[75] Inventor: Richard C. Roe, Palatine, Ill.

[73] Assignee: Sealy, Inc., Chicago, Ill.

[21] Appl. No.: 822,728

[22] Filed: Aug. 8, 1977

[51] Int. Cl.[2] ..... A47C 23/00

[52] U.S. Cl. ..... 5/269

[58] Field of Search ..... 5/267, 269, 261, 263

[56] References Cited

U.S. PATENT DOCUMENTS

| | | | |
|---|---|---|---|
| 238,490 | 3/1881 | Dalrymple | 5/269 |
| 426,022 | 4/1890 | Jeffery | 5/269 |
| 2,052,325 | 8/1936 | Travis | 5/269 |
| 2,374,850 | 5/1945 | Wunderlich | 5/269 |
| 3,653,082 | 4/1972 | Davis | 5/269 |

FOREIGN PATENT DOCUMENTS

| | | | |
|---|---|---|---|
| 10686 | 5/1909 | United Kingdom | 5/269 |
| 359762 | 10/1931 | United Kingdom | 5/263 |

*Primary Examiner*—Kenneth J. Dorner

*Attorney, Agent, or Firm*—Roy E. Hofer; Joan I. Norek

[57] ABSTRACT

The improved mattress innerspring unit is provided which includes a plurality of coil springs arranged in a plurality of substantially parallel rows, a plurality of cross helicals extending transversely of the rows of coil springs, lacing together adjacent springs along their terminal convolutions in both the upper and lower surfaces of the unit, at least one border wire extending about the perimeter of the unit and at least one cross helical cap mounted on the end revolutions of a cross helical which cap includes a means for restraining movement of the cross helical outward of the unit. The restraining means of the cross helical cap is positioned inward of the border wire and provides a positive abutment for the end revolution of the cross helical, preventing movement beyond the border wire. A cross helical cap is also provided which is adapted to be mounted on the end of a cross helical and restrain movement of the cross helical beyond a border wire of an innerspring unit.

16 Claims, 9 Drawing Figures

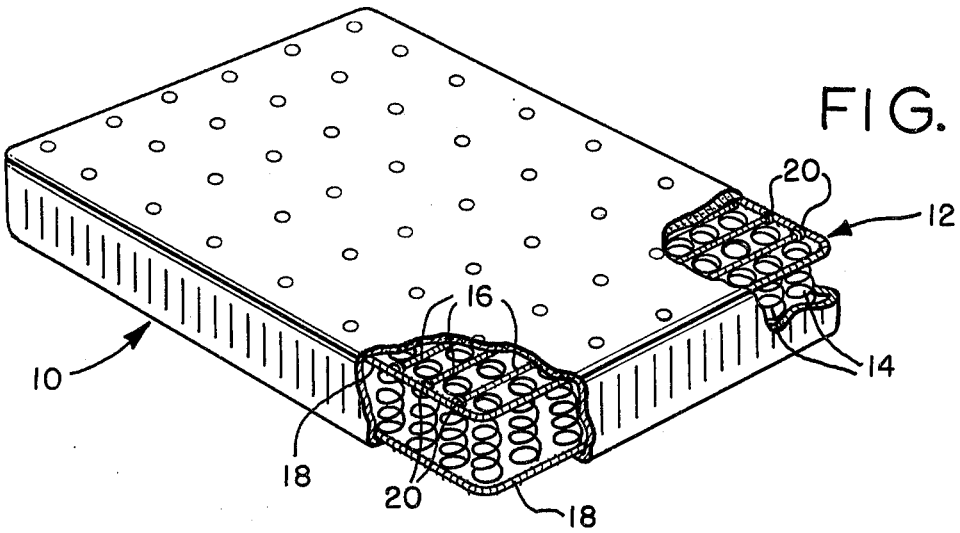
FIG. 1
FIG. 2
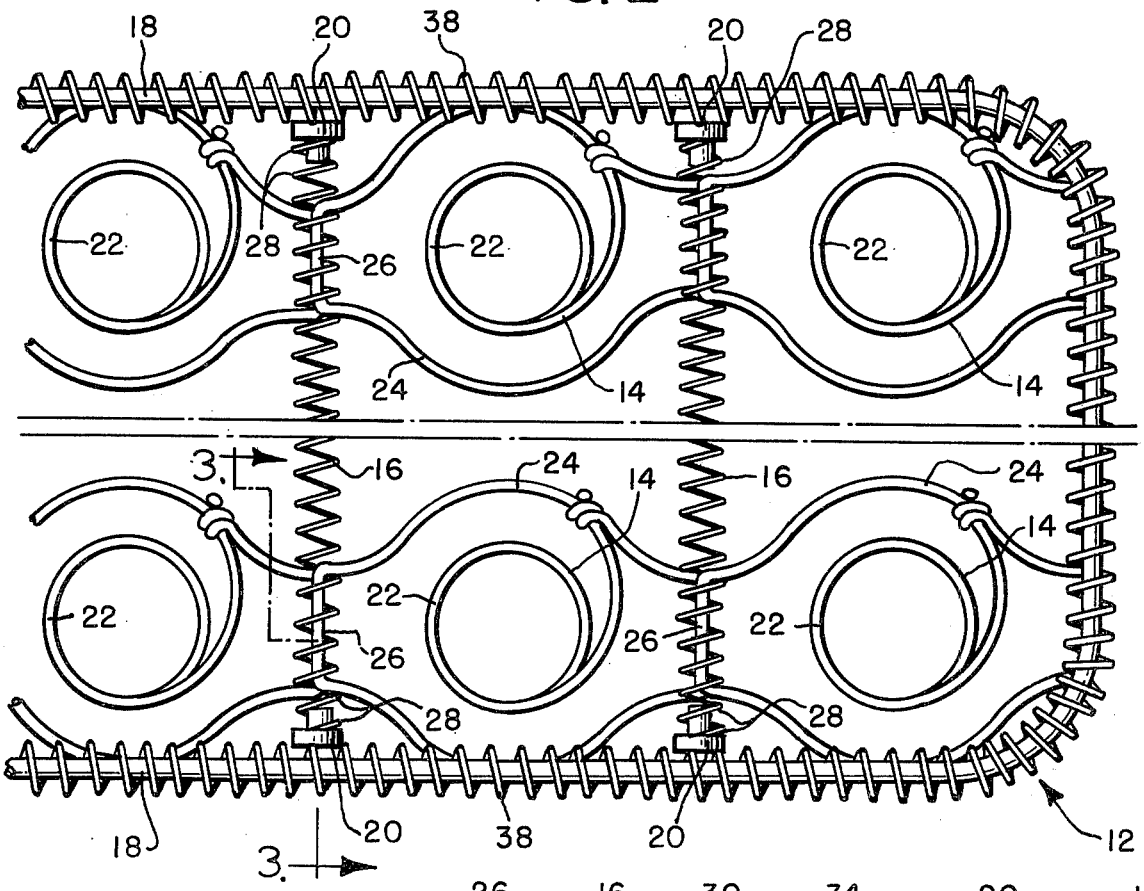
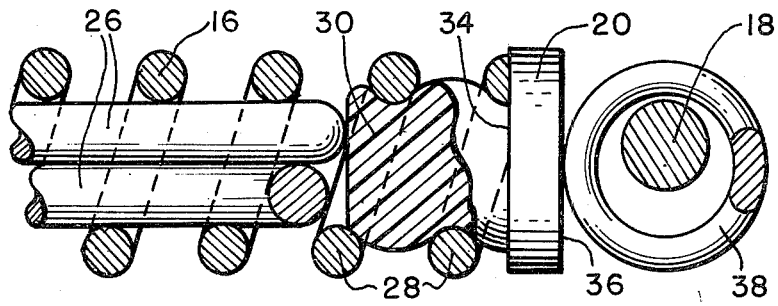
FIG. 3

FIG. 4
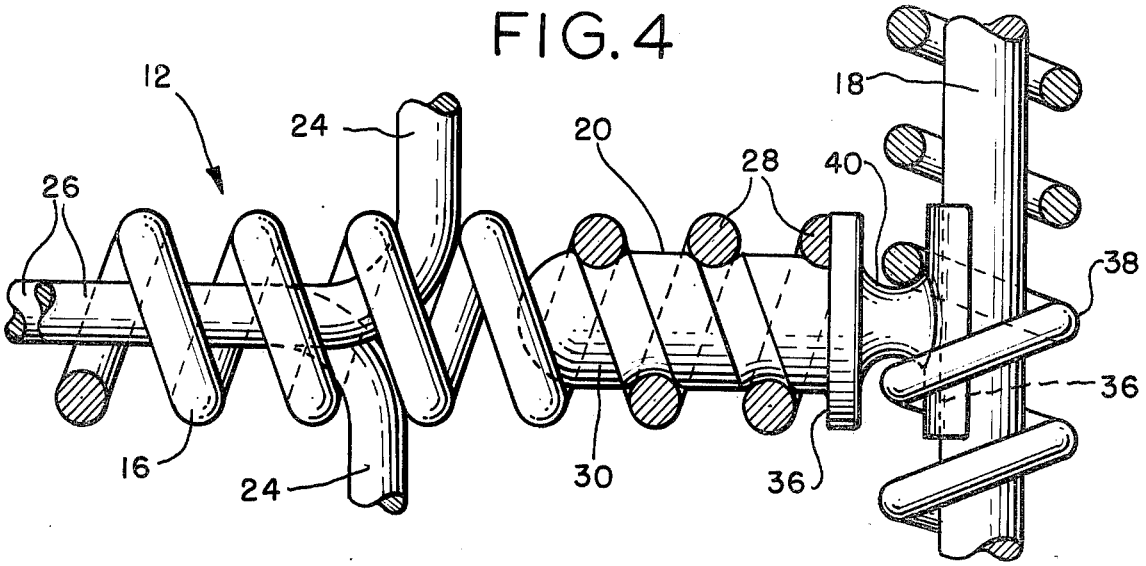
FIG. 5
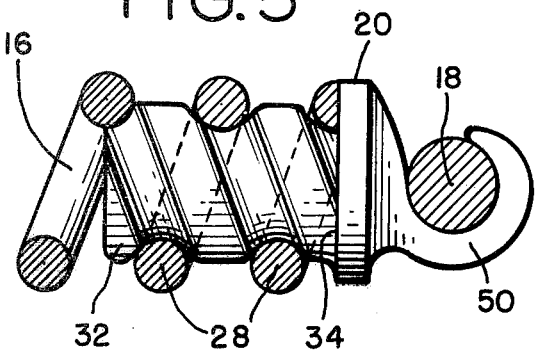
FIG. 6
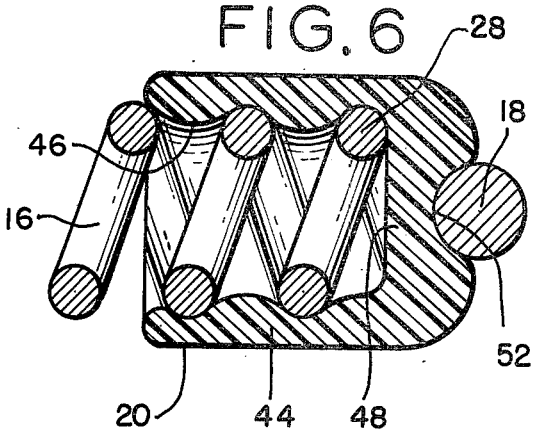
FIG. 7
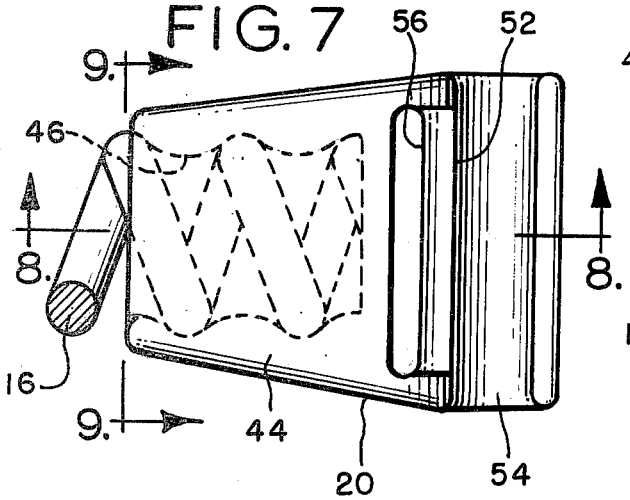
FIG. 8
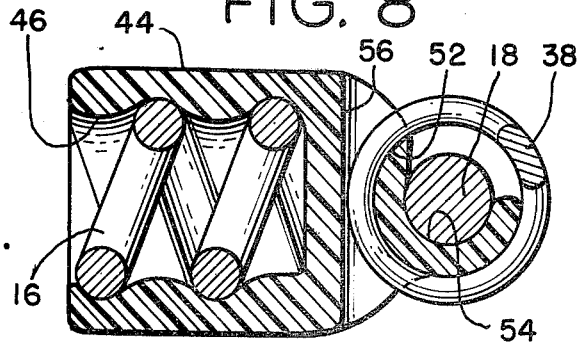
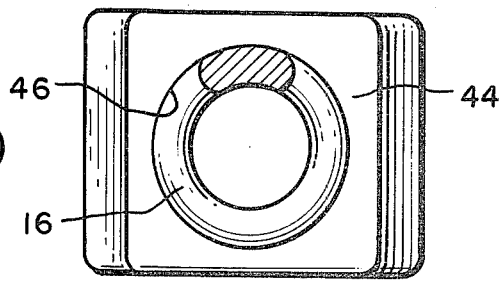
FIG. 9

MEANS FOR RESTRAINING CROSS HELICAL SPIN-OUT

BACKGROUND OF THE INVENTION

This invention relates to an improvement in mattress innerspring units and, more particularly, to a means for preventing the tendency of cross helicals to unwind or spin-out from the unit.

Mattress innerspring units are generally formed of a plurality of coil springs positioned standing side-by-side in a plurality of substantially parallel rows. The end or terminal convolutions of the coil springs define the upper and lower surfaces of the unit. Springs adjacent to one another in the same row are interconnected by cross helicals which laced together the coil springs along both their terminal convolutions. The cross helicals therefore extend transversely of the rows of coil springs in both the upper and lower surfaces of the unit. Mattress inner spring units generally include two border wires which extend about the perimeter of the unit. The border wires are normally secured to the upper or lower terminal convolutions of the coil springs at the perimeter of the unit by means of border wire helicals which lace the terminal convolutions and border wires together.

The cross helicals are incorporated into the unit by rotating them spirally about their major axis until they extend across the rows of coil springs, each cross helical interconnecting, i.e., lacing together, a pair of adjacent coil springs in each row along either their upper or lower terminal convolutions. Once the cross helicals are so positioned, they have a tendency to "spin-out", that is, unwind from the innerspring unit. This longitudinal movement of cross helicals is extremely undesirable, resulting in deterioration of the construction of the innerspring unit. A means for preventing cross helical spin-out that is economical and not disruptive of the general methods for assembling innerspring units is greatly advantageous.

It has been the practice to eliminate spin-out by deforming the cross helicals in various manners. Cross helicals have been deformed at their ends by bending the end back upon themselves or forming loops therein, such as is described in U.S. Pat. Nos. 3,006,629 and 2,374,850. Cross helicals have also been distorted at a point along their lengths, such as is described in U.S. Pat. No. 3,685,062.

It has also been the practice to prevent longitudinal movement of cross helicals by providing frictional engagement of the helicals with the coil springs, such as is described in U.S. Pat. Nos. 2,254,106 and 3,653,082.

In spring assemblies which include helical wires disposed between spiral coils which do not lace the coils together, it is known to interconnect the spiral coils and helical wires by means of clips, as described in U.S. Pat. No. 2,052,325. A further known manner of connecting helical wires not laced about terminal convolutions of adjacent coil springs in disclosed in British Pat. No. 10,686. This patent describes an assembly of spiral coils including a helix extending around the periphery and a number of longitudinally extending helices. The longitudinal helices are secured to the periphery helix by clips with two perpendicular threaded sockets to receive the two helices.

It is desirable that cross helicals which extend across the rows of coil springs lacing together adjacent spiral coils be restrained from spinning-out or unwinding from the innerspring unit. It is further desirable to restrain cross helical spin-out by such means that does not increase the cost of construction of an innerspring unit to any appreciable extent and is not disruptive of the generally used methods of construction. It is further desirable to prevent spin-out by a means which is not dependent on deforming the cross helicals because deformations can be decreased in effectiveness upon extending or severe use of an innerspring unit.

It is often desirable to increase the overall firmness of an innerspring unit which is the ratio of resistance provided by the unit per unit load of compressive force applied. Firmness is dependent upon a number of variables particularly coil count (ie number of spiral coils per unit) and the extent of hinging movement between spiral coils. It would be advantageous to increase the firmness of a unit without increasing the coil count and therefore the cost of the unit.

It would also be desirable to eliminate the need for border wire helicals by providing a means for preventing cross helical spin-out which also secures the border wire to the unit, decreasing the cost of construction.

It is therefore an object of the present invention to provide a mattress innerspring construction including a rigid border wire wherein cross helical spin-out is eliminated by providing a restraining means at the end of the cross helicals which prevents them from moving beyond the border wire. It is another object of the invention to provide a restraining means adapted to be mounted at the end of a cross helical and secured to the adjacent border wire to prevent spin-out.

It is a further object of the invention to provide a means for preventing spin-out while increasing the firmness of the innerspring unit. It is also an object to prevent cross helical movement while eliminating the need for border wire helicals to secure the border wires to the unit.

SUMMARY OF THE INVENTION

The foregoing and other objects are realized in accord with the invention by providing a cross helical cap including mounting means for securing the cap to the end of a cross helical and means for restraining longitudinal movement of the cross helical beyond the adjacent border wire. The objects are also realized in accord with the invention by providing a mattress innerspring unit including cross helicals which extend transversely of the rows of coil springs and lace together adjacent coil springs in the row and rigid border wires extending about the periphery of the unit, wherein the cross helicals are prevented from movement beyond the adjacent border wire by providing a cross helical cap mounted on the cross helical ends.

The innerspring unit generally has cross helicals and a rigid border wires in both its upper and lower surfaces. The cross helicals usually extend several revolutions beyond the laced portion of the coil springs at the two longitudinal sides of the unit. The perimeter of the unit is defined by the rigid border wire. As the unit is initially constructed, the revolutions at each end of the cross helicals are disposed outwardly of the laced portion of coil springs and inwardly of the adjacent border wire. The cross helical caps of the present invention, when mounted on the end revolutions of the cross helicals, prevent them from moving beyond the adjacent border wire.

The cross helical cap in one embodiment of the invention includes a mounting means with a cylindrical bore adapted to receive several end revolutions of the cross helical. In a preferred embodiment of the invention, the cross helical cap includes mounting means adapted to be received by several end revolutions of the cross helical.

The restraining means of the cross helical cap provides a positive abutment for the endmost cross helical revolution. In one embodiment of the invention, the positive abutment is provided by a closed end of a cylindrical bore. In another embodiment, a shoulder provides the abutment.

The restraining means also engages the border wire. In one embodiment, the cross helical cap is adapted to abut and frictionally engage the rigid border wire upon longitudinal movement of the cross helical outwardly of the unit. In another embodiment, the cap is secured to the rigid border wire. In a preferred embodiment of the invention, the cap is adapted to receive and hold the border wire eliminating the need for the border wire helical. When a cap, secured to the border wire, is provided at both ends of a cross helical, not only is all cross helical longitudinal movement restrained, but additional firmness is also provided to the unit.

The invention and its objects, method of operation, features and advantages will be more fully understood by reference to the following drawings and the detailed description.

DESCRIPTION OF THE DRAWINGS

FIG. 1 is a partially cut-away perspective view of the mattress with an innerspring unit embodying features of the present invention;

FIG. 2 is a sectional top view of an innerspring unit embodying features of the present invention;

FIG. 3 is a cross-sectional view of a portion of the innerspring unit of FIG. 2, taken along lines 3—3 of FIG. 2;

FIG. 4 is a cross-sectional view of a portion of an innerspring unit illustrating a preferred embodiment of the invention;

FIG. 5 is a cross-sectional view of a portion of innerspring unit, illustrating a preferred embodiment of the present invention;

FIG. 6 is a cross-sectional view of a portion of an innerspring unit illustrating an embodiment of the present invention;

FIG. 7 is a cross-sectional view of a portion of an innerspring unit embodying features of the present invention;

FIG. 8 is a cross-sectional view of a portion of the innerspring unit of FIG. 8, taken along lines 8—8 of FIG. 7; and FIG. 9 is a cross-sectional view of the portion of the innerspring unit of FIG. 7, taken along lines 9—9 of FIG. 7.

DETAILED DESCRIPTION OF THE INVENTION

Referring now to the drawings, particularly FIG. 1, there is illustrated a mattress embodying features of the present invention, indicated generally by the reference numeral 10. The mattress 10 includes an innerspring unit designated generally 12. The unit 12 includes a plurality of coil springs 14 arranged in a plurality of substantially parallel rows, a plurality of cross helicals 16 extending transversely of the rows lacing together the coil springs 14, and two rigid border wires 18 extending about the perimeter of unit 12. The cross helicals 16 and border wires 18 are disposed in both the upper and lower surfaces of the unit 12 and the cross helicals 16 are positioned inwardly of the border wires 18. The cross helicals 16 are provided at their ends with cross helical caps designated generally 20. The cross helical caps 20, together with the border wires 18, provide a rigid barrier for cross helicals 16 which move outwardly of the unit. The cross helicals 16 are thereby prevented from moving beyond the border wires 18, i.e. from spinning-out of the unit 12. The caps 20 also may provide additional firmness to the unit 12 or secure the border wires 18 to the unit 12, as discussed in detail below.

Referring also to FIGS. 2 and 3, the innerspring unit 12 is generally rectangular assembly of coil springs 14 which springs 14 include a series of revolutions 22 tapered towards the center of the springs 14 and two end or terminal convolutions 24. The present invention includes however a unit 12 with coil springs 14 of any suitable configuration, the selection of which is within the ordinary skill of one in the art. The terminal convolutions 24 are generally formed as closed loops and may be formed to have two opposed U-shaped offset portions 26 as shown in the drawings.

The coil springs 14 are positioned in the unit 12 so that their terminal convolutions 24 are in close proximity to the terminal convolutions 24 of adjacent coil springs 14 in the same row. When the terminal convolutions 24 are formed with offsets 26, the coil springs 14 are disposed so that their offsets 26 are in close proximity with adjacent offsets 26 in the same row. Adjacent offsets 26 may advantageously be positioned in overlapping relationship to reduce the hinging action between coil springs 14 and thereby increase the firmness of the unit. That is, when a compressive force is applied to an area of the unit 12, the force is resisted not only by the coil springs 14 in that area, but also in part by the springs 14 in the adjacent areas when the springs 14 are not allowed to hinge or move independently of adjacent springs 14.

The cross helicals 16 extend transversely of the rows of coil springs 14 in both the upper and lower surfaces of the innerspring unit 12. The cross helicals 16 are rotated about their major axes and each cross helical 16 laces together a pair of adjacent coil springs 14 in each of the rows along either their upper or lower terminal convolutions 24. When the terminal convolutions 24 have U-shaped offsets 26, the cross helicals 16 interconnect the coil springs 14 by lacing about the adjacent offsets 26.

The cross helicals 16 have several end revolutions 28 that extend beyond the laced portion of the outermost coil springs 14 at both longitudinal side borders of the innerspring unit 12. These end revolutions 28 are disposed outwardly of the laced portion of coil springs 14 and inwardly of the adjacent border wire 18. At least the end revolutions 28 at one end of a cross helical 16 are provided with a cross helical cap, designated generally 20, which prevents movement beyond the border wire 18.

The cross helical cap 20 as shown in FIGS. 1 to 3, includes a cylindrical shaft 30 which is received by the cross helical end revolutions 28. The shaft 32 is frictionally engaged to the end revolutions 28 by means of threads on the shaft 30 which correspond to the pitch of the end revolutions 28. The cylindrical shaft 30 could also be adapted to frictionally engage the end revolutions 28 by being constructed of a material sufficiently resiliant to allow insertion into the end revolutions 28 and thereafter return to a configuration which as sufficient cross-sectional diameter to frictionally engage the end revolutions 28 along their inner surfaces.

The cross helical cap 20 also includes a restraining means, designated generally 32. The restraining means 32 includes a shoulder 34 adjacent to the cylindrical shaft 30 and a surface 36 disposed opposite the shoulder 34 which will engage the border wire 18 upon longitudinal movement of the cross helicals 16 theretoward. When the border wire 18 is disposed within the circumference of a border wire helical 38 and the surface 36 has a width greater than the border wire helical 38, the surface 36 will engage the border wire 18 by contacting and frictionally engaging the border wire helical 38. The surface 36 is preferably circular in shape with a diameter approximately equal to the cross-sectional diameter of the border wire 18. The surface 36 may be beveled so as to include recesses which will receive the border wire 18 and provide a firmer frictional engagement therewith. The cross helicals 16 are prevented from longitudinal movement beyond the border wires 18 by the cross helical cap 20 whose surface 36 will engage the border wire 18 and whose shoulder 34 will provide a positive abutment for the end revolutions 28 of the cross helicals 16.

The border wires 18, are constructed of a substantially rigid material and extend about the perimeter of the innerspring unit 12, adjacent to the outermost coil springs 14 in both the longitudinal and end borders of the unit 12. The border wires 18 are shown interconnected to the perimeter coil springs 14 by means of the border wire helicals 38 which are each rotated about one of the border wires 18 and lace it to the terminal convolutions 24 of the perimeter coil springs 14.

In FIG. 4 and FIGS. 5 to 9 that will be discussed later, the invention is illustrated by one helical cap 20 and the adjacent cross helical end revolutions 28 and a portion of the border wire 18. The units 12 however may include a plurality of cross helical caps 20 that may be positioned in both the upper and lower surfaces of the unit 12 which caps 20 may be the same or a combination of embodiments.

Referring now to FIG. 4, there is illustrated an embodiment of the invention, an innerspring unit 12 including cross helicals 16 which lace together coil springs 14 and border wires 18 connected at the periphery of the unit 12 by border wire helicals 38 wherein the outermost surface 36 of the cross helical cap 20 is secured to the border wire 18 by means of the border wire helical 38. The cross helical cap 20 includes a cylindrical shaft 30 which tapers into a neck 40 of cross-sectional diameter smaller than the pitch of the border wire helical 38. (The pitch of a helical is the distance between two adjacent revolutions.) The tapered neck 40 passes between revolutions of the border wire helical 38. The shoulder 34 and outer surface 36 form a wedge of such diameter that the border wire helical 38 is rotated about both the border wire 18 and the adjacent wedge. The wedge is sufficiently elongated so as to be secured to the border wire 18 by several revolutions of the border wire helical 38. In this embodiment of the invention and other embodiments discussed below wherein the cross helical cap 20 is rigidly secured to the border wire 18, outward longitudinal movement of the cross helical 16 is prevented. Therefore, the spin-out of the cross helicals 16 at both side borders of the unit 12 is prevented by providing a cross helical cap 20 at one end only of the cross helicals 16. Alternatively, such cross helical caps 20 may be provided at both ends of the cross helicals 16, whereby the cross helicals 16 will be held in a firm position and prevented from longitudinal movement inward of the unit 12, providing an additional resistance to compression at any point along their lengths. The cross helical caps 20 thereby provide increased firmness to the innerspring unit 12.

Referring now to FIG. 5, there is illustrated a portion of an innerspring unit 12 including a cross helical cap 20 mounted on the end revolutions 28 of the cross helical 16 and secured to a border wire 18. The helical cap 20 includes a cylindrical shaft 32 received by the cross helical end revolutions 28 and a shoulder 34 extending beyond the cross-sectional diameter of the shaft 32. The shoulder 34 is not continuous yet provides a rigid abutment for the end revolutions 28. The cap 20 includes an arm 50 adjacent to the shoulder 34, which arm 50 wraps about a portion of the circumference of border wire 18, rigidly securing the cross helical cap 20 thereto and preventing the cross helical 16 from movement beyond the border wire 18. As illustrated in the drawing, the arm 50 is formed integrally and is constructed of a sufficiently flexible material to enable it to be snapped on to border wire 18. The arm 50 could alternatively be provided with a hinging means to allow it to be extended to receive the border wire 18 and thereafter be locked into position. As illustrated in FIG. 5, the border wire helical 38 may be eliminated from the unit 12, because the border wire 18 is secured to the periphery of the units 12 by means of the arm 50. In such an embodiment, however, the arm 50 could be adapted so as to have a sufficiently narrow width to allow a border wire helical 38 to pass over the arm 50 if an additional means for securing the border wire 18 to the unit 12 is desired.

The above discussed embodiments of the invention wherein the cross helical cap 30 is mounted by means of a cylindrical shaft 30 which is inserted into the end revolutions 28 are preferred embodiments because the cylindrical shaft 30 is protected by the cross helical revolutions 28 from any external abrasive forces that may distort or deteriorate the shaft 32. Deterioration of the frictional engagement of the end revolutions 28 and the shaft 30 is prevented and any distortion of the revolutions 28 due to extreme conditions of use of the unit 12 would result in a narrowing of a portion thereof, resulting in a stronger frictional engagement of the shaft 30.

The present invention also provides a cross helical cap 20 with a housing 44 adapted to receive the cross helical end revolutions 28, as illustrated in FIGS. 6 through 9. The housing 44 includes a cylindrical bore 46 which bore has one closed end 48 positioned inwardly of the cap 20. The bore 46 receives the cross helical end revolutions 28 and the closed end 48 provides a positive abutment, preventing longitudinal movement of the cross helical when the cap 30 is held stationary. The cap 20 also includes an elongated base 52 which will abut the border wire 18 upon longitudinal movement of the cross helical 16 theretoward. The outwardly facing base 52 may be adapted to be rigidly connected to the border wire 18 in the same manner described above for the wedge formed by the shoulder 34 and outer surface 36.

Referring now particularly to FIGS. 7 to 9, there is illustrated a cross helical cap 20 which includes a housing 44 with a closed ended cylindrical bore 46 and base 52. The base 52 is formed with a recess 54 along one of its sides and an aperture 56 extending through the base 52 which aperture is positioned between the recess 54 and the top of the base 52 opposite the recess 54. The recess 54 receives a portion of the border wire 18 and the aperture 56 provides a passageway for the border wire helical 38. The cross helical cap 20 is secured to the broder wire 18 by being laced thereto by the border wire helical 38 which passes through the aperture 56 while the recess 54 is positioned substantially abutting the border wire 18 and prevents any twisting or movement of the cross helical cap 20.

The cross helical caps 20 may be constructed of any suitable material such as plastic or metal and may be formed as a one-piece unit or constructed of several components secured together, particularly when more than one material is used in the construction.

The present invention includes an innerspring unit 12 with at least one cross helical cap 20 mounted upon the end revolutions 28 of at least one cross helical 16 at one end thereof. The present invention also includes a unit 12 with a plurality of cross helical caps 20 mounted at the ends of a plurality of cross helicals 16 which caps 20 may be the same or different. The present invention includes a unit 12 with cross helicals 16 which are provided with a cross helical cap 20 at either one or both of its ends.

The present invention also includes a cross helical cap 20 adapted for use in an innerspring unit 12.

It will be understood that changes may be made in the details of construction, arrangement in operation without departing from the spirit of the invention, particularly as defined in the following claims.

I claim:

1. The combination of a cross helical cap and an innerspring unit which innerspring unit includes a plurality of coil springs arranged in a plurality of substantially parallel rows, a plurality of cross helicals extending transversely of the rows of coil springs, lacing together adjacent coil springs in each row, at least one of said cross helicals extending several revolutions beyond the laced portion of the coil springs, and at least one border wire extending about the perimeter of the innerspring unit and positioned adjacent at least one cross helical end, said cross helical cap comprising:

a cylindrical shaft adapted to be received by a cross helical and threaded for frictional engagement thereto; and means for restraining longitudinal movement of the cross helical beyond the border wire, which restraining means includes an outer surface adapted to abut the adjacent border wire upon longitudinal movement of the cross helical toward said border wire and a shoulder means which provides a positive abutment for the end of the cross helical to reduce cross helical spin-out, said restraining means being formed integrally with said cylindrical shaft.

2. The cross helical cap of claim 1 wherein the restraining means is adapted to be laced together with the border wire by a border wire helical, said cylindrical shaft tapering to a cross-sectional diameter smaller than the pitch of a border wire helical adjacent said shoulder means, and said shoulder means and outer surface together forming an elongated wedge.

3. The cross helical cap of claim 1 wherein the outer surface and shoulder means of the restraining means are formed as a curved arm member adapted to receive a border wire.

4. The cross helical cap of claim 1 wherein said outer surface of said restraining means is recessed to provide a firmer frictional engagement with a border wire upon contact.

5. The combination of a cross helical cap and an innerspring unit which innerspring unit includes a plurality of coil springs arranged in a plurality of substantially parallel rows, a plurality of cross helicals extending transversely of the rows of coil springs lacing together adjacent coil springs in each row, at least one of said cross helicals extending several revolutions beyond the laced portion of the coil springs, and at least one border wire extending about the perimeter of the innerspring unit and positioned adjacent at least one cross helical end, said cross helical caps comprising:

a shaft with a cylindrical bore adapted to receive the end revolutions of cross helical; and means for restraining longitudinal movement of the cross helical beyond the border wire including an outwardly facing base member which closes the adjacent end of the cylindrical bore to provide a positive abutment for the end of a cross helical to reduce cross helical spin-out.

6. The cross helical cap of claim 5 wherein the shaft is formed integrally with said base member.

7. The cross helical cap of claim 5 wherein said base member is adapted to abut an adjacent border wire upon longitudinal movement of the cross helical toward said border wire and is recessed to provide a firmer frictional engagement with a border wire upon contact.

8. The cross helical cap of claim 7 wherein said base member includes an aperture between its outwardly recessed side and said cylindrical shaft for providing a passageway for a border wire helical and is thereby adapted to be laced together with the border wire by a border wire helical.

9. The cross helical cap of claim 7 wherein the base member is formed as a curved arm member adapted to receive the border wire.

10. In a generally rectangular innerspring mattress, a spring structure comprising:

a plurality of coil springs arranged in a plurality of substantially parallel rows;

plurality of cross helicals extending transversely of the rows of coil springs in both the upper and lower surfaces of the spring structure and lacing together adjacent coil springs in each row, at least one of said cross helicals extending several revolutions beyond the laced portion of the coil springs;

at least one border wire extending about the perimeter of the spring structure and positioned adjacent to at least one cross helical end; and at least one cross helical cap, mounted at the end of a cross helical, including means for restraining movement of the cross helical outward of the unit and for providing positive abutment for the end of the cross helical, said restraining means including an outer surface which abuts the adjacent border wire upon longitudinal movement of the cross helical toward said border wire and shoulder means which provides a positive abutment for the end revolution of said cross helical, and said restraining means being disposed between the end revolution of said cross helical and the adjacent border wire, whereby cross helical spin-out is reduced; and wherein the cross helical cap includes a cylindrical shaft adapted to be received by the cross helical, said cylindrical shaft being formed integrally with the restraining means and being threaded to provide frictional engagement with the receiving cross helical.

11. The spring structure of claim 10 wherein the structure includes a border wire helical and the restraining means is laced together with the border wire by the border wire helical wherein the cylindrical shaft of the cross helical cap tapers to a cross-sectional diameter less than the pitch of the border wire helical and said outer surface and shoulder means form an elongated wedge.

12. The spring structure of claim 10 wherein said outer surface and shoulder means form a curved arm member that receives the border wire.

13. In a generally rectangular innerspring mattress, a spring structure comprising:

a plurality of coil springs arranged in a plurality of substantially parallel rows;

a plurality of cross helicals extending transversely of the rows of coil springs in both the upper and lower surfaces of the spring structure and lacing together adjacent coil springs in each row, at least one of said cross helicals extending several revolutions beyond the laced portion of the coil springs;

at least one border wire extending about the perimeter of the spring structure and positioned adjacent to at least one cross helical end;

at least one cross helical cap, mounted at the end of a cross helical, including means for restraining movement of the cross helical outward of the unit and for providing positive abutment for the end of the cross helical, said restraining means being disposed between the end revolution of said cross helical and the adjacent border wire, whereby cross helical spin-out is reduced;

said cross helical cap further including a shaft with a cylindrical bore which receives the end revolutions of a cross helical, said shaft being formed integrally with the restraining means; and the restraining means being formed as a base member which closes the adjacent end of the cylindrical bore to form the positive abutment for the cross helical end.

14. The spring structure of claim 1 13 wherein the base member abuts the adjacent border wire upon longitudinal movement of the cross helical toward said border wire and is recessed along its outer side to provide a firmer frictional engagement with said border wire.

15. The spring structure of claim 13 wherein the structure includes a border wire helical and the base member is laced together with the border wire by the border wire helical and the base member includes an aperture through which the border wire helical passes.

16. The spring structure of claim 13 wherein the base member is formed as a curved arm member which receives the border wire.

* * * * *

UNITED STATES PATENT AND TRADEMARK OFFICE

CERTIFICATE OF CORRECTION

PATENT NO. : 4,155,130

DATED : May 22, 1979

INVENTOR(S) : Richard C. Roe

It is certified that error appears in the above-identified patent and that said Letters Patent are hereby corrected as shown below:

Column 10, line 14 "claim 1 13" should read -- claim 13 --

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*